US005193863A

United States Patent [19]

McBain

[11] Patent Number: 5,193,863

[45] Date of Patent: Mar. 16, 1993

[54] FOOT ACTIVATED DOOR OPENER

[75] Inventor: Theodore McBain, Tahoe City, Calif.

[73] Assignee: Tahoe Bare Paw, Inc., Tahoe City, Calif.

[21] Appl. No.: 849,872

[22] Filed: Mar. 12, 1992

[51] Int. Cl.[5] ..... E05C 1/16

[52] U.S. Cl. ..... 292/255; 292/336.3; 292/DIG. 71

[58] Field of Search ..... 292/DIG. 71, 255, 336.3, 292/DIG. 25

[56] References Cited

U.S. PATENT DOCUMENTS

| | | | |
|---|---|---|---|
| 533,571 | 2/1895 | Tower | 292/255 |
| 966,444 | 8/1910 | Hole | 292/255 |
| 1,076,506 | 10/1913 | Marshall | 292/255 |
| 1,087,820 | 2/1914 | Pehrson | 292/255 |
| 1,359,788 | 11/1920 | Bramblett | 292/255 |
| 2,120,534 | 6/1938 | Wild | 292/255 |
| 2,144,737 | 1/1939 | McCabe | 292/255 |
| 2,613,973 | 10/1952 | Brinkoeter | 292/255 |
| 2,741,504 | 4/1956 | Dale | 292/255 |
| 3,271,062 | 9/1966 | Schelin | 292/255 |
| 3,346,288 | 10/1967 | Cosentino | 292/255 |
| 4,621,848 | 11/1986 | Pierce | 292/336.3 |

FOREIGN PATENT DOCUMENTS

| | | | |
|---|---|---|---|
| 909488 | 12/1945 | France | 292/255 |
| 341981 | 1/1931 | United Kingdom | 292/255 |
| 771620 | 4/1957 | United Kingdom | 292/255 |

*Primary Examiner*—Eric K. Nicholson

*Attorney, Agent, or Firm*—Majestic, Parsons, Siebert & Hsue

[57] ABSTRACT

A foot activated door opening device that can be readily retrofitted onto existing doors, especially doors of walk-in type refrigerators is provided. The device includes a lever system that can be readily adjusted to accommodate different size handles. When activated by a foot pedal, the lever system engages the handle which causes the door to open. In another aspect of the invention, a device that is particularly suited for opening a door equipped with a plunger mechanism is provided. The device is foot activated and uses a lever system to engage the plunger.

4 Claims, 3 Drawing Sheets

FOOT ACTIVATED DOOR OPENER

FIELD OF THE INVENTION

The present invention relates generally to a foot operated door opening device particularly suited for opening doors of walk-in type refrigerators.

BACKGROUND OF THE INVENTION

The kitchen of many restaurants and other dining facilities is equipped with a walk-in refrigerator in which the refrigerated compartment consists of a room that can be rather sizable. The walk-in refrigerator door is usually equipped with a spring assisted, latch on the outer door panel while the inside panel is equipped with a plunger-type opening device. One problem constantly encountered is that in order to open the door, one must use his hands to release the latch or press against the plunger. In many instances, a person literally drops whatever is being held in order to open the door.

BRIEF SUMMARY OF THE INVENTION

The object of the present invention is to provide a foot activated door opening device that can be readily retrofitted onto existing doors, especially doors of walk-in type refrigerators.

This and other objects are accomplished with the present invention one aspect of which includes a lever system that can be readily adjusted to accommodate horizonal handles of varying sizes and that is activated by a foot pedal. When activated the lever system engages the handle which causes the door to open.

In another aspect of the invention, a device that is particularly suited for opening a door equipped with a plunger opening mechanism is provided. The device is foot activated and uses a lever system to engage the plunger.

DETAILED DESCRIPTION OF THE PREFERRED EMBODIMENT

Figure 1:
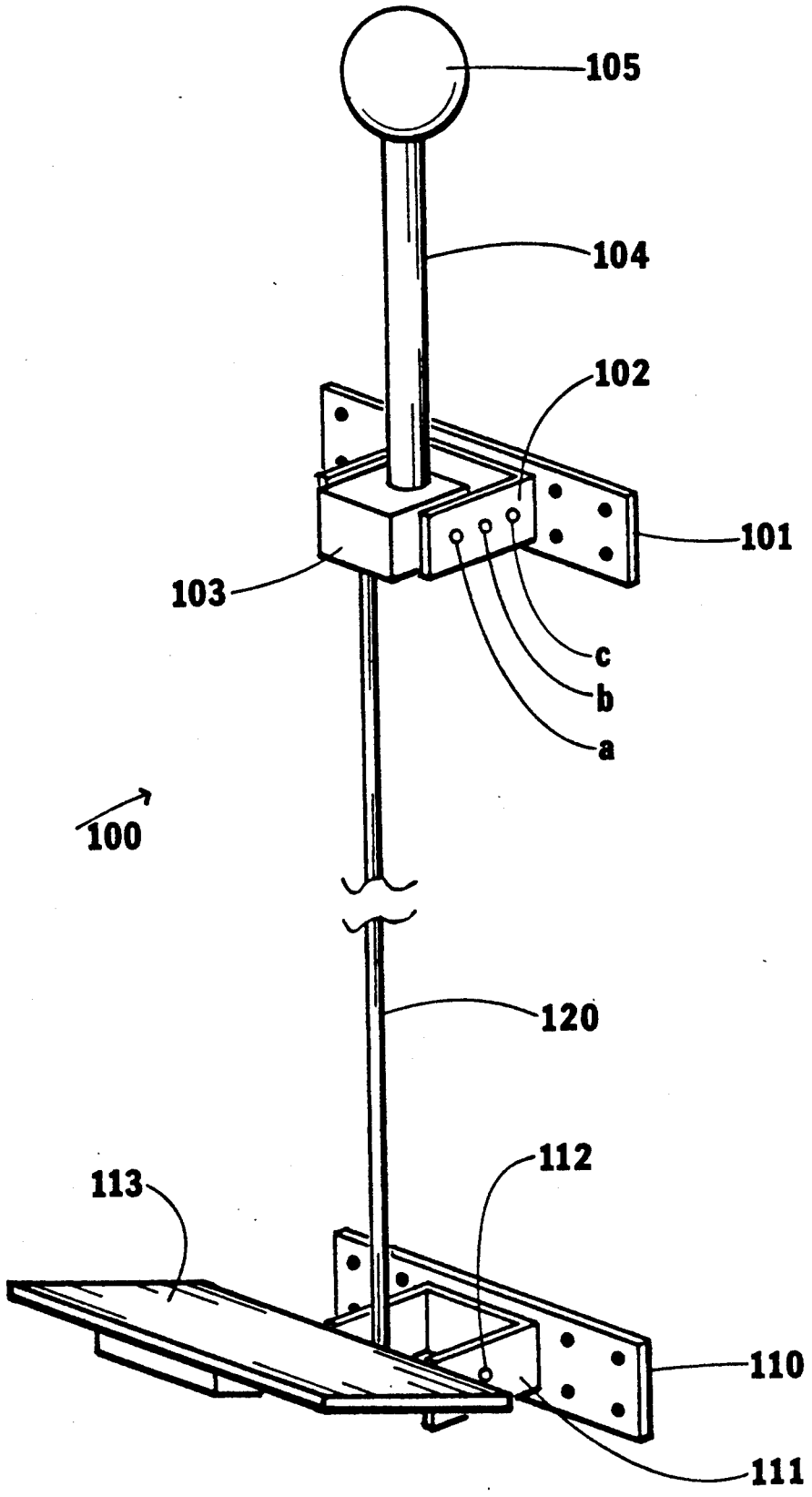
FIG. 1 is a perspective view of a foot activated door opening device for use with a horizontal handle.

FIG. 1 shows a foot activated device 100 that is particularly suited for engaging a horizonal latch or handle that is normally found on the front side of a walk-in type refrigerator. The device 100 can be constructed of any suitable material, including stainless steel, aluminum and plastic, and comprises of an upper bracket 101 that has an adjustable fulcrum 102 attached thereto. The upper bracket can be attached to the door by conventional means such as screws, bolts, and rivets at a position below the horizonal handle. The adjustable fulcrum comprises of two projection-like structures protruding from said upper bracket. The lever support member 103 is movably hinged to the adjustable fulcrum; said member 103 has two pivot members each suitably constructed to fit into a hole or indentation located on each of said projection-like structures. In this embodiment, each projection-like structure has three holes (designated a, b, and c) each of which can accommodate a pivot member. With a plurality of holes on the fulcrum, the position of the lever support member can be adjusted to accommodate different horizonal handles. (The space or gap between the door and the handle will vary depending on the refrigerator model.) This enables the inventive device to be retrofitted onto the doors to most walk-in refrigerators. Attached to the top surface of lever support member 103 is lever 104 which has a knob 105.

Positioned substantially below said upper bracket and also affixed to the door is a lower bracket 110. The lower bracket 110 is also attached to the door by conventional means. In addition, the lower bracket has two projection-like structures 111 each having a hole or indentation 112. Pedal member 113 is movably hinged onto structures 111 as will be further described herein below.

Force is transmitted from the pedal member to the lever via cable 120. The cable ;20 should be constructed of material that is relatively pliable yet inelastic. Suitable materials include nylon. The first end of the cable is attached to the pedal member and the second end of the cable is attached to the level support member. The cable should be taut so that substantially all the force applied on the pedal is transmitted to the lever. As will be appreciated by those skilled in the art, the first end of the cable should be attached to the pedal at a point as far from the lower bracket (or door) as feasible so that when the pedal is pressed downward, the cable will exert a sufficient downward force on the lever support member 103. In the same vein, the second end of the cable should be attached on the lever support member at a position away from the upper bracket (or door) so that the downward force (from the pedal) in turn causes lever 104 to move forward (away from the door) to engage the horizonal handle and thereby open the door.

Figure 2:
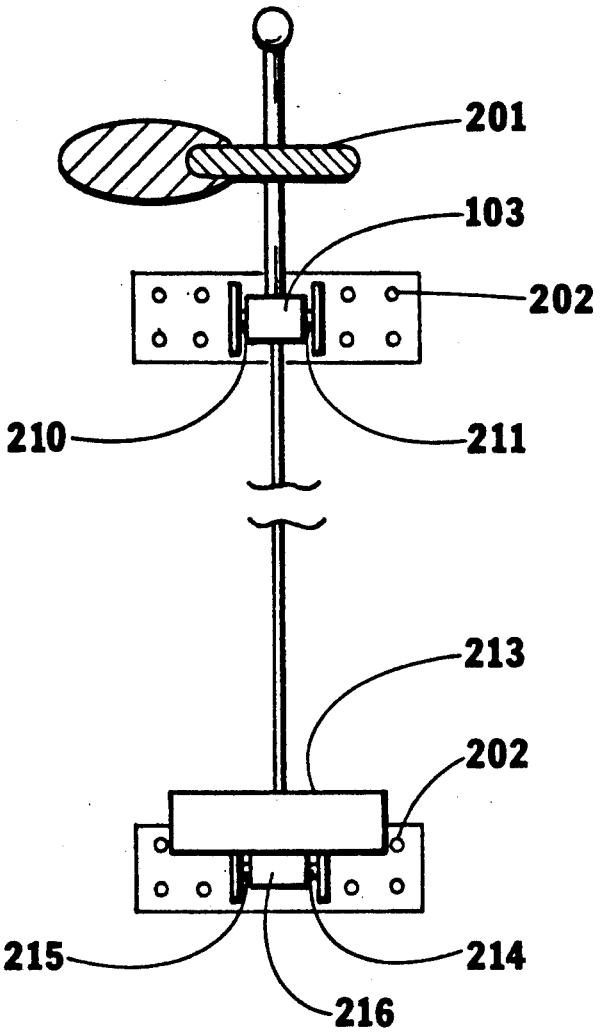
FIG. 2 is a front view of the device of FIG. 1.

FIG. 2 is a front view of the device of FIG. 1 shown that is attached to a door having a door locking system that can be released by exerting an outward force on horizonal handle 201 which is connected to a release mechanism (not shown). In this embodiment, the upper and lower brackets are secured onto the door with screws 202. The lever support member has two pivot members 210 and 211 that each fit into a hole located in each of the projection-like structures of the fulcrum. The foot pedal comprises an upper platform 213, that should have a rough surface to prevent slippage, and a lower member 216 having pivot members 215 and 216 that each fit into a hole located in structure 111.

In operation, when an individual presses the foot pedal, the resulting force causes the lever to swing forward and engage the horizonal latch which unlocks the door. Alternatively, with the present invention, the individual can simply pull the lever by hand.

Figure 3:
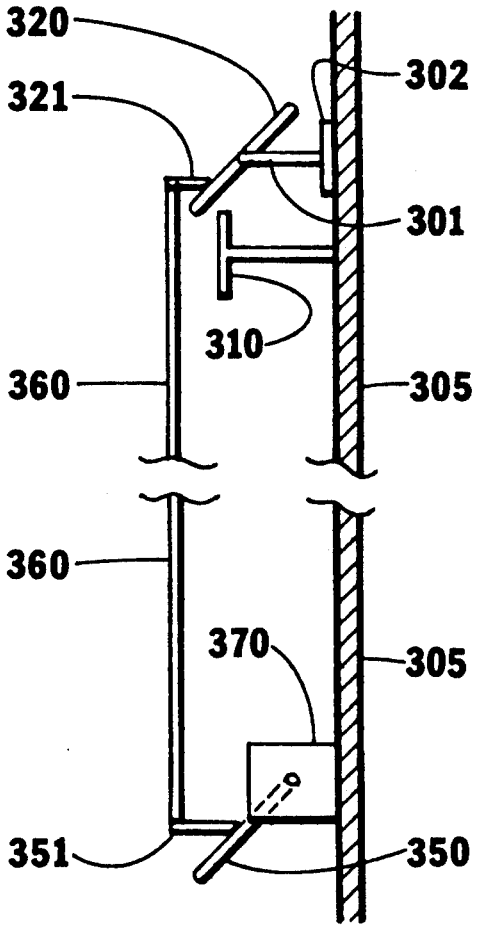
FIG. 3 is a side view of a foot activated door opening device for use with a plunger-type mechanism.

FIG. 3 is a side view of a foot activated device particularly suited for opening a walk-in refrigerator door that is equipped by a plunger-type door mechanism, which is usually on the interior side of the door. The device comprises of fulcrum 301 suitably attached to refrigerator door 305 by upper bracket 302. The fulcrum is positioned above the plunger 310. Lever 320 is movably hinged onto fulcrum 301 and the lever has cantilever member 321 attached thereto. The device also comprises a foot pedal member 350 that is pivotally attached to lower bracket 370. The lower bracket is suitably affixed to the door below the plunger so that an individual can easily press against the foot pedal member. Attached to the pedal member is cantilever member 351. Connecting one end of cantilever 321 and one end of cantilever 351 is cable 360. In operation, pressing the foot pedal member causes the lever to engage the plunger which in turn opens the door.

Figure 4:
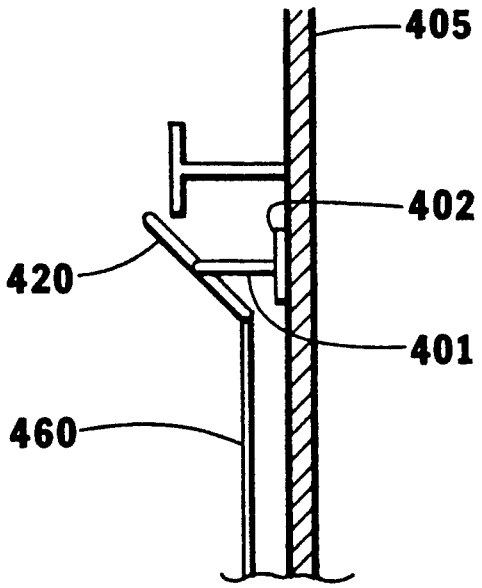
FIG. 4 is an alternative embodiment of the device of FIG. 3.

FIG. 4 shows an alternative embodiment of the device of FIG. 3 in which the fulcrum 401 and lever 420 are positioned below the plunger. The fulcrum is secured to the door 405 by bracket 402. In this embodiment, cable 460 is attached directly to the end of the lever.

Figure 5:
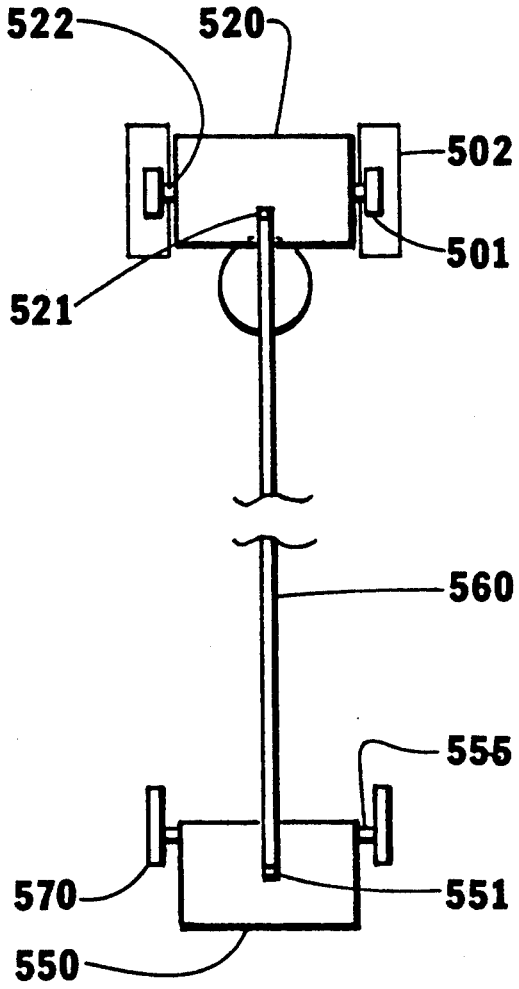
FIG. 5 a front view of the device as shown in FIG. 3.

FIG. 5 is a front view of the device of FIG. 3. The fulcrum comprises two elongated members 501 that are each secured to the door by upper brackets 502. Lever 520 has two pivot members 522 that are movably hinged into holes located in upper bracket 502; attached to lever 520 is cantilever 521. The device also comprises foot pedal member 550 that is pivotally mounted by pivot members 555 to lower bracket 570. Attached to the foot pedal is cantilever 551. Cable 560 connects the ends of cantilever 521 and 555.

It is to be understood that While the invention has been described above in conjunction with preferred specific embodiments, the description and examples are intended to illustrate and not limit the scope of the invention, which is defined by the scope of the appended claims.

It is claimed:

1. A foot activated door opener adapted for opening a door that is releasably locked by a locking mechanism that can be disengaged by the outward action of a horizontal latch comprising:

a pedal member positioned substantially directly below said latch, wherein said pedal is affixed to said door for reversible vertical movement;

fulcrum means positioned slightly below said latch and attached to said door for guiding a lever that is attached thereto to move outward away from said door to engage said latch when said pedal member is pressed;

a vertical lever suitably attached to said fulcrum so that said lever is positioned between said latch and said door; and means for connecting said pedal member to said fulcrum so that pressing said pedal member downward causes said lever to engage said latch.

2. The device as defined in claim 1 further comprising of:

an upper bracket affixed to said door and having means for adjustably attaching said fulcrum to said upper bracket so that said lever can be positioned between said latch and said door; and a lower bracket affixed to said door and having means for attaching said pedal member thereto.

3. A foot activated door opener adapted for opening a door that is located by a locking mechanism that can be disengaged by the inward action on a plunger-type release handle comprising:

a pedal member positioned substantially below said plunger wherein said pedal is affixed to said door for reversible vertical movement;

lever means for engaging said plunger;

pivot means providing a fulcrum onto which said lever means is attached and for guiding the lever to move inward towards said door to engage said plunger-type release handle when said pedal member is pressed, wherein said pivotal means is affixed to said door adjacent to said plunger; and means for connecting said pedal member to said lever so that pressing said pedal member causes said lever to engage said plunger.

4. The device as defined in claim 3 wherein said lever further comprises a first cantilever to which said connecting means are attached and wherein said pedal means further comprises a second cantilever to which the connecting means is attached.

* * * * *

UNITED STATES PATENT AND TRADEMARK OFFICE

CERTIFICATE OF CORRECTION

PATENT NO. : 5,193,863

DATED : MARCH 16, 1993

INVENTOR(S) : McBAIN

It is certified that error appears in the above-identified patent and that said Letters Patent is hereby corrected as shown below:

| | |
|---|---|
| Claim 3, column 4, line 18 | Delete "located" and insert --locked-- |
| Claim 3, column 4, line 29 | Delete "pivotal" and insert --pivot-- |

Signed and Sealed this

Twenty-third Day of November, 1993

Bruce Lehman

*Attest:*

BRUCE LEHMAN

*Attesting Officer*

*Commissioner of Patents and Trademarks*